US010239307B2

(12) United States Patent
Le Maître

(10) Patent No.: US 10,239,307 B2
(45) Date of Patent: Mar. 26, 2019

(54) PRINTING SYSTEM FOR PRINTING ON A SUBSTANTIALLY PLANAR SURFACE OF A 3D-OBJECT AND A METHOD FOR PRINTING THEREOF

(71) Applicant: Océ-Holding B.V., Venlo (NL)

(72) Inventor: Catherine M. H. A. Le Maître, Antony (FR)

(73) Assignee: OĆE-HOLDING B.V., Venlo (NL)

( * ) Notice: Subject to any disclaimer, the term of this patent is extended or adjusted under 35 U.S.C. 154(b) by 0 days.

(21) Appl. No.: 15/619,057

(22) Filed: Jun. 9, 2017

(65) Prior Publication Data

US 2017/0355184 A1 Dec. 14, 2017

(30) Foreign Application Priority Data

Jun. 10, 2016 (EP) ..... 16173907

(51) Int. Cl.

| | |
|---|---|
| ***B41F 17/24*** | (2006.01) |
| ***B41F 17/30*** | (2006.01) |
| ***B41J 3/407*** | (2006.01) |
| ***B41F 15/08*** | (2006.01) |
| ***B41F 19/00*** | (2006.01) |
| ***B41F 33/16*** | (2006.01) |

(52) U.S. Cl.

CPC ..... *B41F 15/0881* (2013.01); *B41F 19/007* (2013.01); *B41F 33/16* (2013.01); *B41J 3/4073* (2013.01)

(58) Field of Classification Search

USPC ..... 358/1.1–3.29, 1.11–1.18, 504; 345/418, 345/419, 626–628, 653, 654

See application file for complete search history.

(56) References Cited

U.S. PATENT DOCUMENTS

| | | | | |
|---|---|---|---|---|
| 2009/0303507 | A1* | 12/2009 | Abeloe | B29C 64/386 358/1.9 |
| 2012/0075399 | A1 | 3/2012 | Polus | |
| 2014/0026773 | A1 | 1/2014 | Miller | |
| 2016/0171744 | A1* | 6/2016 | Rhoads | G06K 9/00208 345/419 |
| 2017/0132837 | A1* | 5/2017 | Iverson | G06T 17/10 |
| 2017/0256093 | A1* | 9/2017 | Choi | G06T 17/20 |

OTHER PUBLICATIONS

European Search Report of application EP 16 17 3907, dated Nov. 22, 2016.

* cited by examiner

*Primary Examiner* — Marcellus J Augustin

(74) *Attorney, Agent, or Firm* — Birch, Stewart, Kolasch & Birch, LLP

(57) ABSTRACT

A printing system for printing on a substantially planar surface of a 3D-object includes a printer for printing on the planar surface of the 3D-object and a controller configured to control printing of the printer. The printing system further includes a mask generation module configured to generate a mask having the shape of the planar surface from a 3D-model of the 3D-object and to provide the controller with the mask to prevent printing outside the planar surface according to the mask.

5 Claims, 4 Drawing Sheets

PRINTING SYSTEM FOR PRINTING ON A SUBSTANTIALLY PLANAR SURFACE OF A 3D-OBJECT AND A METHOD FOR PRINTING THEREOF

CROSS REFERENCE TO RELATED APPLICATIONS

This application claims priority under 35 U.S.C. § 119(a) to Application No. 16173907.3, filed in Europe on Jun. 10, 2016, the entire contents of which is hereby incorporated by reference into the present application

BACKGROUND OF THE INVENTION

1. Field of the Invention

The invention is in the field of printing systems for printing on a substantially planar surface of a 3D-object and a method for printing thereof.

2. Background of the Invention

Printing systems for printing on a substantially planar surface of a 3D-object are known in the art. For example, flatbed printers can be used for applying ink on the planar surface of the 3D-object. Also, flatbed printers can be used for applying several layers of ink in the planar surface to represent texture and to provide tactile details in said planar surface, which is known as 2.5D printing or relief printing.

The planar surface is a surface of the 3D-object being substantially flat to be printed on. However, the shape of the planar surface may not be rectangular, having rounded parts and angles, and even said planar surface may comprise openings. As consequence, the printing system may provide poor printing since small errors, such as printing on the openings or lateral sides of the 3D-object can be easily seen on the final outcome.

Published U.S. Patent Application 2012/075399 A1 to Polus discloses depositing a substance with a substance-depositing device on the surface of an object by moving the substance-depositing device along the surface, tracking the position of the substance-depositing device, indicating the tracked position on a computer-generated representation of the surface, and commanding the substance-depositing device to deposit the substance on the surface if the indicated tracked position crosses an extruded surface normal to the object surface, the extruded surface determining a location for depositing the substance.

SUMMARY OF THE INVENTION

It is an object of the present invention to alleviate the above mentioned problem. To this end, a first aspect of the invention provides a printing system for printing on a substantially planar surface of a 3D-object, the printing system comprising:

a) printing means for printing on the planar surface of the 3D-object; and b) control means configured to control printing of the printing means;

wherein the printing system further comprises a mask generation module configured to generate a mask having the shape of the planar surface from a 3D-model of the 3D-object and to provide the control means with the mask to prevent printing outside said planar surface according to the mask.

A second aspect of the invention provides a method for generating a mask of a substantially planar surface of a 3D-object, wherein the mask is generated from a 3D-model of the 3D-object such that said mask has the shape of the planar surface.

A third aspect of the invention provides a method for printing on a substantially planar surface of a 3D-object, the method comprising the step of using a mask to limit printing to the planar surface of the 3D-object, wherein the method further comprises the step of generating the mask from a 3D-model of the 3D-object such that said mask has the shape of the planar surface to limit printing to said planar surface of the 3D-object.

Finally, a fourth aspect of the invention relates to a computer program product comprising a computer readable storage medium, wherein the computer readable storage medium comprises a program, and the program enables a computer and/or a mask generation module of a printing system to execute the method of generating a mask when the program is run in the computer and/or the mask generation module.

DETAILED DESCRIPTION OF THE INVENTION

The first aspect of the invention concerns a printing system according to claim 1. In this way, a printing system with improved control for limiting printing to a substantially planar surface of a 3D-object is provided.

The printing system according to the invention comprises a printing means for printing on the planar surface. The printing system comprises a printer, in general a flatbed printer, comprising a printing head and means for moving the printing head and/or the 3D-object to be printed on to perform printing.

The printing means is controlled by control means configured to control the printing being performed by said printing means. The control means are arranged for printing and may comprise a user interface comprising a hardware device, a software program, an electronic circuit or combinations thereof for such purpose. In an example of the invention, the printer may comprise the control means. In a more specific example, the control system may be arranged in a workstation detached from the printer, although in communication with said printer to control the printing system.

The printing system according to the invention further comprises a mask generation module configured to generate a mask and to provide the control means with the mask for printing on said planar surface according to the mask. The use of the mask allows for limiting printing performed by the printing means to a desired area of the 3D-object. The mask may be a bitmap with white pixels corresponding to an area where there is no printing and black pixels corresponding to an area where there is printing, similar to those used in 2.5D printing. The mask generation module may comprise a hardware device, a software program, an electronic circuit or combinations thereof. In a different example, the control means comprises the mask generation module.

The mask generation module is further configured to generate the mask having an area corresponding to the planar surface of the 3D-object intended to be printed. For such purpose, the mask is obtained from a 3D-model of said 3D-object. In this way, the area defined by the mask for limiting printing corresponds to an area having the shape of the planar surface of the 3D-object. Thus, printing performed by the printing means is improved since rounded parts, angles and openings present in the planar surface of the 3D-object are taken into account.

The 3D-model may be generated by the printing system, although in general said 3D-model is previously generated by any method known in the art to be input to the printing system for generating the mask. Then, an area of the 3D-model can be selected, in general via the user interface. In a more specific example, the 3D-model may be a mesh model comprising a plurality of 2D-faces, and the faces of the mesh model corresponding to the planar-surface are selected.

In an embodiment, the mask generation module is configured to generate the shape of the mask from a mesh model defined by a plurality of 2D-faces by selection of 2D-faces of the plurality having a corresponding normal with respect to a reference normal of a reference 2D-face arranged in a position of the mesh model corresponding to the planar surface of the 3D-object. In this way, the corresponding 2D-faces of an area of the mesh model corresponding to the planar surface of the 3D-model can be easily detected and selected. Further, the accuracy of the shape of the mask with respect to the shape of the planar surface can be increased and thus printing performed in said planar surface is even more accurate.

The use of mesh models as 3D-model of a 3D-object is known in the art. The mesh model may define the 3D-object as a plurality of 2D-faces arranged in space. Each of the 2D-faces of the plurality may have three edges, four edges or even more than four edges to provide a more complex 2D-face, also known as a 2D-polygon. In any case, each of said 2D-faces of the mesh model has two dimensions and, therefore, may define a single normal vector that may be arranged inwardly or outwardly with respect to the 3D-model.

The mask generation module according to the invention is configured to determine said normal vector of each of the 2D-faces, arranged inwardly or outwardly with respect to the 3D-model and to select 2D-faces of the mesh model according to their normal vectors. In this way, since 2D-faces of the plurality arranged in a position of the mesh model corresponding to the planar surface of the 3D-object has the same or a similar normal vector, said 2D-faces can be easily detected and selected to provide the mask.

The second aspect of the invention concerns a method for generating a mask of a substantially planar surface of a 3D-object, wherein the mask is generated from a 3D-model of the 3D-object such that said mask has the shape of the planar surface. In this way, a mask having the shape of the planar surface of a 3D-object can be easily provided. The mask can be used thus in a printing process to prevent printing outside the planar surface of said 3D-object.

In an embodiment, the 3D-model of the object is a mesh model defined by a plurality of 2D-faces, and the step of generating the mask comprises the sub-steps of:

a) generating a reference normal vector of a reference 2D-face arranged in a position of the mesh model corresponding to the planar surface of the 3D-object;
b) generating a normal vector of a 2D-face of the plurality of 2D-faces of said mesh model to yield a normal vector; and
c) selecting the 2D-face by comparison of its normal vector with the reference normal vector. In this way, a mask having a shape corresponding to the planar surface of the 3D-object can be even more easily generated. Since the mesh model of the 3D-object is defined by the plurality of 2D-faces arranged in space and each 2D-face may define a single normal vector, 2D-faces of the said mesh model corresponding to the planar face of the 3D-object would have a similar or identical single normal vector. Thus, they can be identified and selected to provide the mask.

The identification and selection is achieved according to a reference normal vector. The reference normal vector is the single normal vector of a 2D-face arranged in an area of the mesh model corresponding to the planar surface. Thus by selection of only one 2D-face corresponding to the planar surface to be printed, the reference normal vector arranged inwardly or outwardly with respect to the 3D-model can be obtained for comparison.

The comparison may be done once at least a normal vector corresponding to a 2D-face is generated. In an example, normal vectors are generated for 2D-faces adjacent to the reference 2D-face. Then, if said adjacent 2D-faces are selected after comparison, further normal vectors corresponding to further 2D-faces adjacent to said adjacent 2D-faces are generated. These sub-steps will continue until comparison does not allow for selection of more 2D-faces. In a more specific example, all the normal vector for all the 2D-faces are generated for comparison.

If the reference normal vector is generated inwardly with respect to the 3D-model, the normal vectors for comparison are also to be generated inwardly. The same is to be acknowledged if the reference normal vector is arranged outwardly, the normal vectors for comparison being also arranged outwardly.

The comparison sub-step is achieved by comparing the reference normal vector with the normal vector of a 2D-face within a range. The range is defined such that the 2D-face defined by said normal vector in combination with the reference 2D-plane defines a substantially planar surface of the 3D-object. Thus, the range selected further allows for controlling the accuracy of the shape of the mask during the selection of the 2D-faces depending on the range of variation. Thus, the smaller the range of variation, the more accurate the selection is, and the more similar the shape of the mask is with respect to the shape of the planar surface. In an example of the invention, the selecting sub-step may be done only when both the normal vector and the reference normal vector are substantially equal, providing the highest accuracy.

The reference 2D-face may be selected by a user selecting such 2D-face displayed in a user interface displaying the 3D-model or part of the 3D-model. The selecting in the user interface may be done by means of a pointing device as is known in the art.

The third aspect of the invention concerns a method for printing on a planar surface of a 3D-object, the method comprising the step of using a mask to limit printing to the planar surface, wherein the mask is generated from a 3D-model of the object as mentioned above. In this way, a method providing a more accurate printing on a planar surface of a 3D-object is achieved. In the method, a printing system may be arranged for generating the 3D-model by any method known in the art via the mask generation module. In a different example, a printing system known in the art, such as a flatbed printer is further configured to provide printing by using a mask, the mask being obtained from a 3D-model by any method known in the art. In both examples the mask used has a shape according the area of the 3D-model corresponding to said planar surface of the 3D-object. The method may be performed by the printing system according to the invention as defined above.

The fourth aspect of the invention concerns a computer program product comprising a computer readable storage medium, wherein the computer readable storage medium comprises a program, and the program enables a computer and/or a mask generation module of a printing system to execute the method of generating a mask according to anyone of claims 3 to 5 when the program is run in the computer and/or the mask generation module.

BRIEF DESCRIPTION OF THE DRAWINGS

For the purpose of illustrating the invention, the drawings show aspects of one or more embodiments of said invention. However, it should be understood that the present invention is not limited to the precise arrangements and instrumentalities shown in the drawings, wherein:

FIG. 2A is a view of a 3D-object to be printed on;

DETAILED DESCRIPTION OF THE PREFERRED EMBODIMENTS

It should be noted that items which have the same reference numbers in different figures, have the same structural features and the same functions. Where the function and/or structure of such item has been explained, there is no necessity for repeated explanation thereof in the detailed description.

It should be noted that the above-mentioned embodiments illustrate rather than limit the invention, and that those skilled in the art will be able to design many alternative embodiments.

Figure 1:
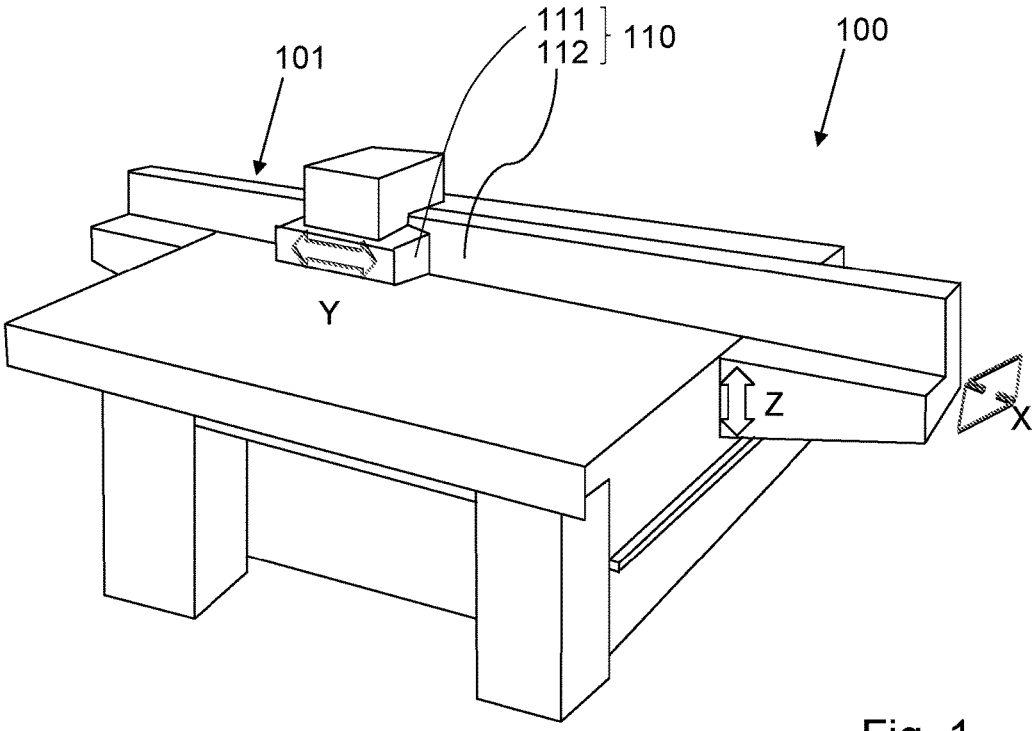
FIG. 1 is a view of a printer according to the invention.

FIG. 1 depicts a printing system 100 according to an example of the invention. The printing system 100 comprises a flatbed printer 101 as known in the art. The flatbed printer 101 comprises a carriage comprising printing means 110. Control means are arranged in a detached workstation (not shown). The printing means 110 comprises a print head 111 arranged on a gantry 112. In this way the printing head may move in a X, Y and Z direction thanks to the cooperation with the gantry 112. The control means comprises a user interface for controlling printing performed by the flatbed printer 101.

The flatbed printer 101 is configured to print on 3D-objects, as for example a 3D-object 200 depicted in FIG. 2, in the present example by having a gantry adjustable in height. The printing means 110 may thus apply ink to a planar surface 210 of the 3D-object 200 via the printing head 111 according to the instructions provided by the control means.

Figure 2A:
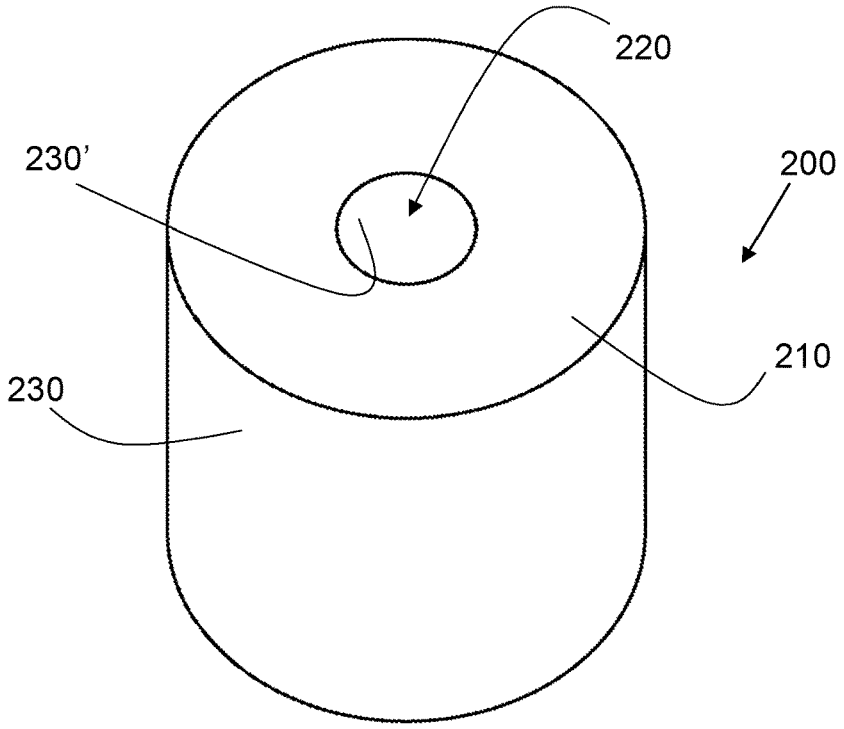
Figure 2B:
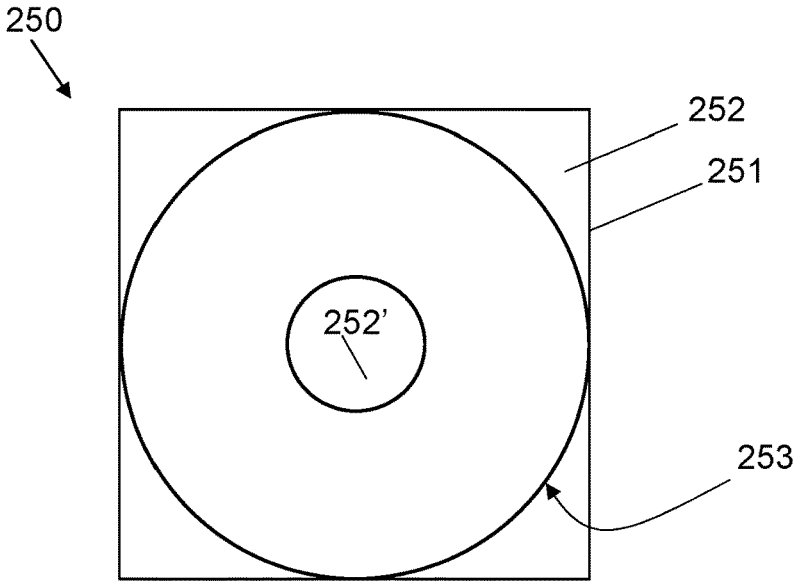
FIG. 2B is a view of a mask to be used for printing a surface of the 3D-object depicted in FIG. 2A.

A challenge that the printing means 110 faces when printing on the planar surface 210 of the 3D-object 200 depicted in FIG. 2A is that the perimeter of said planar surface 210 is rounded and further comprises an opening 220. This might make it difficult to control printing and increases the possibility of applying ink in the opening 220 or the lateral surfaces 230 and 230' of the 3D-object 200, which can be easily noticed in the printing outcome.

In order to improve control of the printing means 110, the printing system 100 further comprises a mask generation module. In the present example, the mask generation module is a software program arranged in the user interface and configured to provide a mask 250 (see FIG. 2B) from a 3D-model 300 (see FIG. 3) of the 3D-object 200. Further, the mask generation module is further configured to provide the control means with the mask to limit printing provided by the printing means 110 to said planar surface 210 according to the mask 250. However, it is important to note that in a more specific example, a flatbed printer may be configured to perform printing according to a mask and that said mask is obtained offline, that is that said mask is generated separately from the flatbed printer to be input to the control means together with an image to be printed on the substantially planar surface to perform printing.

The mask 250 comprises a rectangular bitmap 251 having an area 252 and 252' filled with white pixels and an area 253 filled with black pixels. The areas 252 and 252' represent the area of the mask where there will be no printing and the area 253 represent the area where there is printing, as known in 2.5D printing. It is important to note that other descriptions of the mask known in the art may be used.

Figure 3A:
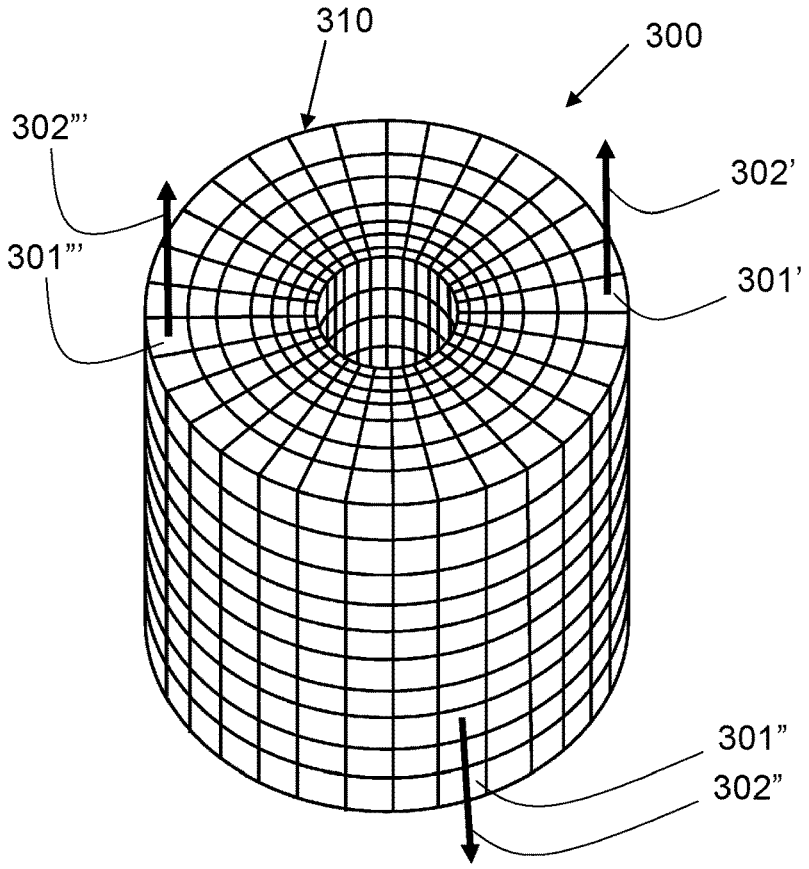
FIG. 3A is a view of a 3D-model of the 3D-object of FIG. 2A.
Figure 3B:
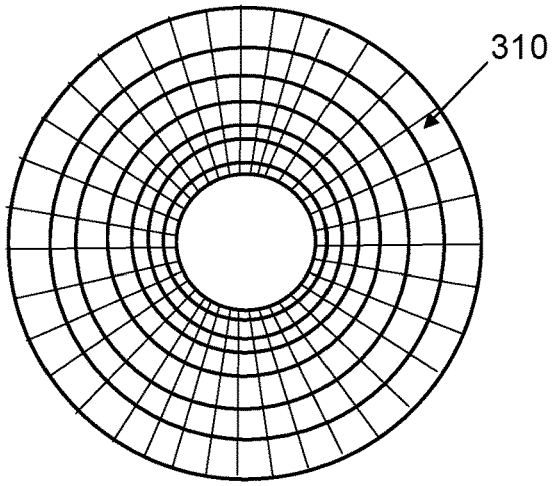
FIG. 3B is a surface of the 3D-model of FIG. 3A.

The mask 250 generated by the mask generation module is obtained from a 3D-model 300 of the 3D-object 200, as depicted in FIG. 3A. In the present example, the 3D-model 300 is mesh model 300. The mesh model 300 may have been obtained by any method known in the art for such a purpose to be input to the mask generation module of the printing system 100.

The mesh model 300 defines the 3D-object 200 as a plurality of 2D-faces 301 arranged in space. In the present example, each 2D-face 301 of the plurality has four edges, corresponding to a quad 301.

Figure 4:
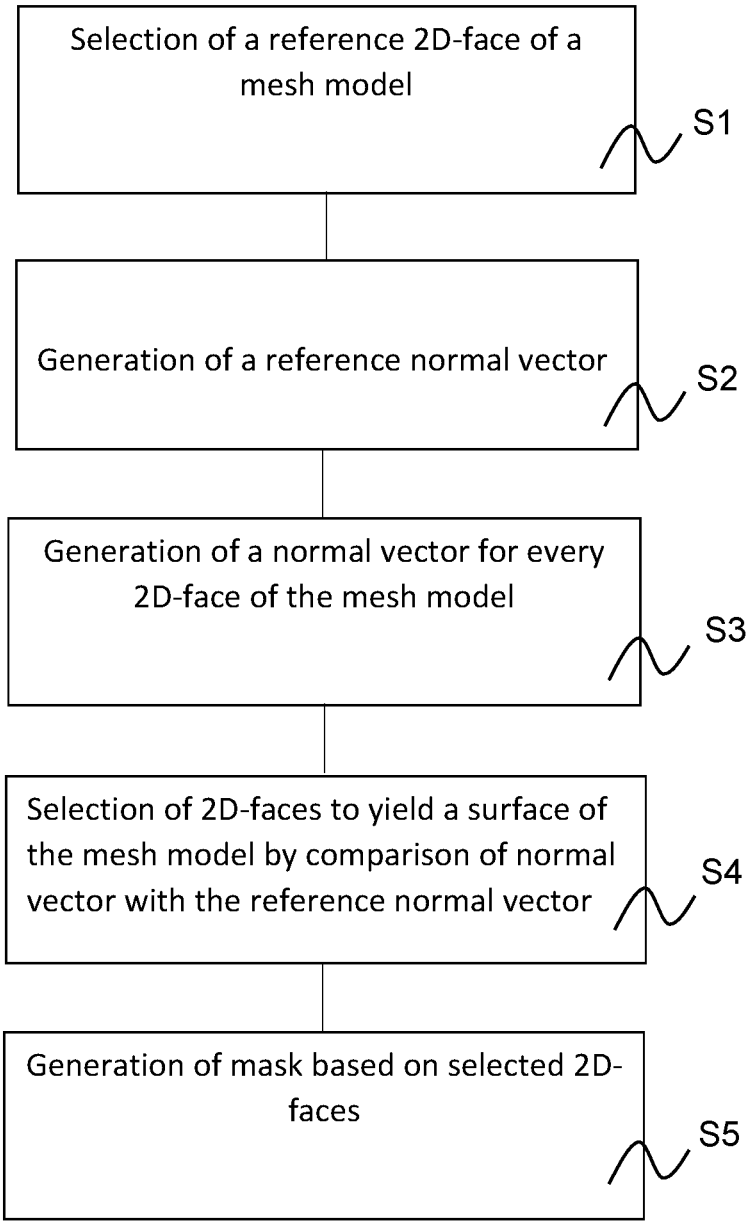
FIG. 4 is a schematic view of a printing method using the printer of FIG. 1

In the present example, the mask generation module is capable of generating the mask 250 from a surface 310 (see FIG. 3B) of the mesh model 300 by application of the method 400 as depicted in FIG. 4. The surface 310 is an area of the mesh model 300 corresponding to the planar surface 210 of the 3D-object 200.

The method 400 starts with a step S1, in which a quad 301' of the area 310 of the mesh model 300 (see FIG. 3A). For the sake of clarity, this quad 301' will be referred below as reference quad 301'. In the present example, the selection of the reference quad 301' is done via the user interface.

The mask generation module of the present example is configured to generate a normal vector 302 corresponding to each of the quads 301 of the mesh model 300. In the present example, the normal vector is arranged outwardly with respect to the 3D-model. Since each of said quads 301 has only two dimensions, there is only a single corresponding normal vector 302 arranged also outwardly for each of said quads 301. Thus, the following step S2 of the method 400 corresponds to the generation of the normal vector 302' of the reference quad 301' that has been selected in the step S1. This normal vector 302' will be referred as reference normal vector 302'. Then, the mask generation module of the present example generates the normal vector corresponding to each of the quads 301 of the plurality according to step S3. For the sake of clarity, FIG. 3A shows the normal vectors 302" and 302''' corresponding to quads 301" and 301''' arranged across the mesh model 300. It is important to note that the mask generation module may also generate normal vectors selectively, that is for squads adjacent to the reference quad, or by choice of the user.

In a following step S4, the mask generation module compares each normal vector 302 with the reference normal vector 302'. In this way, the quads 301 of the plurality defining an area of the mesh model 300 corresponding to the planar surface 210 of the 3D-object 200 and comprising the reference quad 301' can be detected in an easy way. The detection is possible since the normal vectors 302 corresponding to said quads 301 are substantially similar or within a range arranged with respect to the reference normal vector 302' such that all those quads are arranged in a substantially planar area. Thus, selection of said detected quads 301 by comparison yields the surface 310 having the shape of the planar surface 210.

It has to be noted, that the comparison in S4 may be done within a range of values, which is known as tolerance height variation. In the present example, the mask generation unit is configured to set the range as desired, which may have an impact in the selection of the quads 301 depending of the 3D-object.

In a final step S5, the mask 250 is generated. This is achieved since the mask generation module computes the resulting surface 310 to create the rectangular bitmap 251. Then, the resulting surface 310 is used to compute the area 252 and 252' filled with white pixels and the area 253 filled with black pixels. Thus, as both the mask 250 and the area of the mesh model 300 corresponding to the planar surface 210 have the same shape, the mask 250 matches said planar surface 210 of the 3D-object 200. Computation of the area 253 may be done by mapping the selected 2D-faces to the mask 250, for example by orthogonal projection. Note that to properly mask out all areas of the image to be printed that will fall outside the substantially planar surface, the size of the mask should at least be the size of the image to be printed, or alternatively the area outside the mask is implicitly to be treated as an area to be masked out, or in other words an area where printing is to be prevented. In a preferred embodiment the dimensions of the mask are determined by the minimum bounding box of the selected 2D-faces or alternatively the axis-aligned minimum bounding box of the selected 2D-faces.

In one particular embodiment, the image to be printed is mapped to the 3D-model through conventional UV mapping techniques, wherein a mapping maps between the u- and v-coordinates of the image to be printed and the x-, y-, and z-coordinates of the 3D-model. In such embodiment, the mask 250 may be positioned in the same UV-space as the image to be printed and the UV mapping may be used to map the selected 2D-faces to the mask 250. Alternatively, a mapping between the image to be printed and the mask 250 is determined after the mask 250 with the area 253 has been determined, for example by visually relatively positioning and scaling the mask 250 and the image to be printed.

What is claimed is:

1. A printing system for printing on a substantially planar surface of a 3D-object, the printing system comprising:

a computer programmed to function as:

a mask generation module configured to generate a mask having a shape of the planar surface from a 3D-model of the 3D-object from a mesh model defined by a plurality of 2D-faces by selection of 2D-faces out of the plurality of 2D-faces, said selected 2D-faces having a corresponding normal with respect to a reference normal of a reference 2D-face arranged in an area of the mesh model corresponding to the planar surface of the 3D-object; and a controller configured to control printing of the planar surface of the 3D-object according to the generated mask from the mask generation module; and a printer configured to print on the planar surface of the 3D-object under a control of the controller, said control preventing the printer from printing outside said planar surface according to the mask.

2. A method for printing on a planar surface of a 3D-object, comprising:

generating a mask of a substantially planar surface of a 3D-object, said method comprising the step of generating the mask from a 3D-model of the 3D-object such that said mask has the shape of the planar surface, wherein the 3D-model of the 3D-object object is a mesh model defined by a plurality of 2D-faces, and the step of generating the mask comprises the sub-steps of:

generating a reference normal vector of a reference 2D-face arranged in an area of the mesh model corresponding to the planar surface of the 3D-object;

generating a normal vector of a 2D-face of the plurality of 2D-faces of said mesh model to yield a normal vector; and selecting the 2D-face by comparison of the normal vector with the reference normal vector; and using the generated mask to limit printing.

3. The method according to claim 2, wherein the selecting sub-step is done when both the normal vector and the reference normal vector are substantially equal.

4. A computer program product comprising a non-transitory computer readable storage medium, wherein the non-transitory computer readable storage medium comprises a program, and the program enables a computer and/or a mask generation module of a printing system to execute the method of generating a mask according to claim 3 when the program is run in the computer and/or the mask generation module.

5. A computer program product comprising a non-transitory computer readable storage medium, wherein the non-transitory computer readable storage medium comprises a program, and the program enables a computer and/or a mask generation module of a printing system to execute the method of generating a mask according to claim 2 when the program is run in the computer and/or the mask generation module.

* * * * *